United States Patent [19]

Zembrod

[11] Patent Number: 4,844,463

[45] Date of Patent: Jul. 4, 1989

[54] CURLING STONE

[76] Inventor: Xaver Zembrod, Heiligenberger Strasse 26, D 7798 Pfullendorf, Fed. Rep. of Germany

[21] Appl. No.: 147,171

[22] Filed: Jan. 22, 1988

[30] Foreign Application Priority Data

Feb. 7, 1987 [DE] Fed. Rep. of Germany ..... 3703729
Nov. 25, 1987 [DE] Fed. Rep. of Germany ..... 3739917

[51] Int. Cl.[4] ..... A63B 71/00
[52] U.S. Cl. ..... 273/128 CS; 403/290
[58] Field of Search ..... 273/128 CS; 294/89, 294/94, 116; 403/290

[56] References Cited

U.S. PATENT DOCUMENTS 4,290,638 9/1981 Manning ..... 294/89

FOREIGN PATENT DOCUMENTS 25092 of 1902 United Kingdom ..... 273/128 CS

*Primary Examiner*—Edward M. Coven
*Assistant Examiner*—Benjamin Layno
*Attorney, Agent, or Firm*—Becker & Becker, Inc.

[57] ABSTRACT

A curling stone that includes a handle that is interchangeably connected to a carrying disk that is inserted in a stone body. Two or more securing elements are mounted on the handle to effect detachable connection of the latter to the carrying disk. The securing elements are positively radially pivotably mounted on the handle, with each securing element having a portion that faces the carrying disk and that can be secured in a recessed area of the latter.

24 Claims, 8 Drawing Sheets

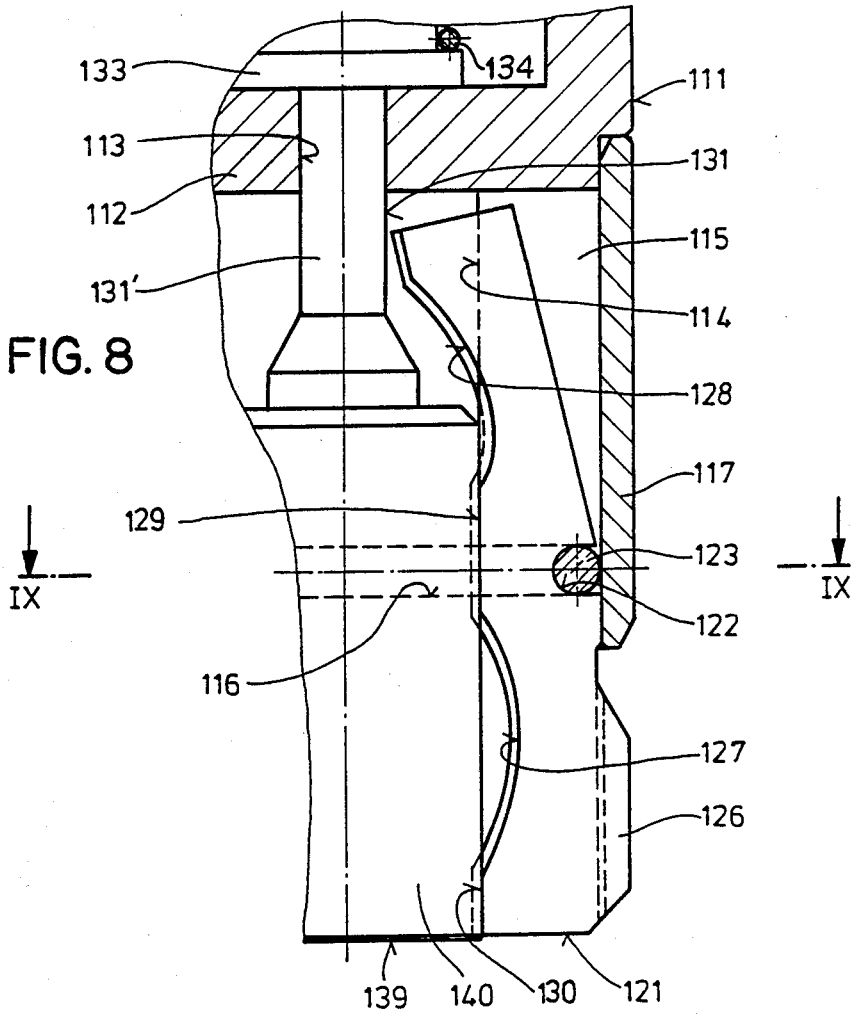
FIG. 8
FIG. 9
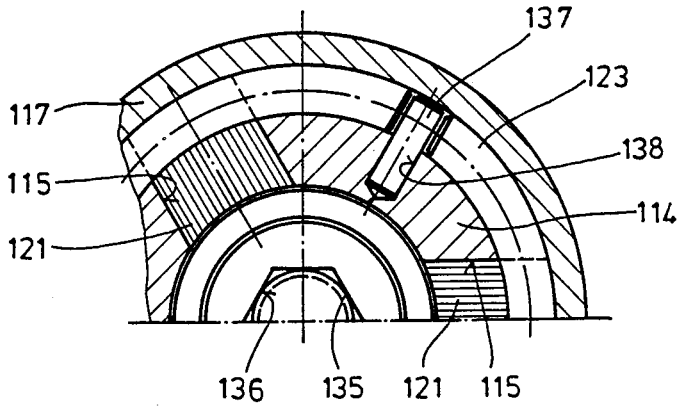

CURLING STONE

BACKGROUND OF THE INVENTION

The present invention relates to a curling stone for play on ice or asphalt, and includes a handle that is interchangeably connected to a carrying disk that is inserted in a stone body.

With the curling stones of this type that have been used up to now, a threaded extension is mounted on the handle. The handle is screwed into the carrying disk of the curling stone via this threaded extension. Although the carrying disk can be detached from the stone body in this manner, and can be replaced with a carrying disk of a different material, this replacement process is very cumbersome and takes a lot of time, since the handle has to be rotated several times in order to release the screw connection. Furthermore, after exchanging the carrying disk, the screw connection has to be reestablished by again rotating the handle several times. Thus, exchanging carrying disks does not involve a simple manipulation.

It is therefore an object of the present invention to embody a curling stone of the aforementioned general type in such a way that the carrying disk can be easily replaced or exchanged in a very short period of time without thereby having to rotate the handle a number of times. Furthermore, without difficulty a connection between the handle and the carrying disk is, to be undertaken by rotating these parts, if at all, by only a very few degrees, although a secure coupling should always be assured, even under stress.

BRIEF DESCRIPTION OF THE DRAWINGS

These and other objects and advantages of the present invention will appear more clearly from the following specification in conjunction with the accompanying schematic drawings, in which:

FIG. 8 is a fragmentary enlarged view illustrating the region of one securing element of the curling stone of FIG. 6;

FIG. 9 is a cross-sectional view taken along the line IX—IX of FIG. 8;

SUMMARY OF THE INVENTION

Figure 1:
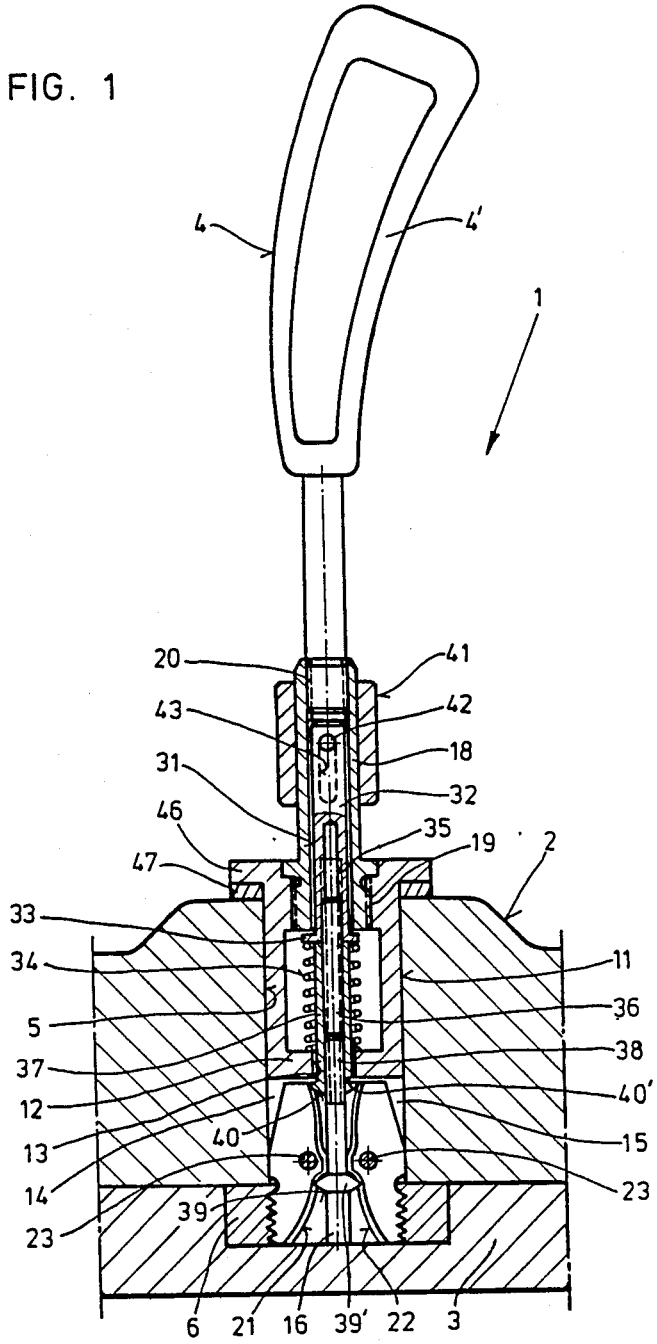
FIG. 1 is a partial axial cross-sectional view through one exemplary embodiment of the inventive curling stone, which is provided with a removable handle.

The curling stone of the present invention is characterized primarily in that two or more securing elements are mounted on the handle to effect detachable connection of the latter to the carrying disk; the securing elements are automatically or positively radially pivotably mounted on the handle, with each securing element having a portion that faces the carrying disk and that can be secured in a bushing or recessed area thereof.

In this connection, it is expedient to dispose the securing elements, each of which is in the form of a double-armed lever, in slot-like free spaces of a sleeve that is secured to the handle, and to pivotably mount the securing elements on pivot pins, which are held in the sleeve and are disposed perpendicular to the longitudinal axis thereof, on a circumferential ring, or on similar pivot means.

If a ring is provided for pivotably holding the securing elements, this ring is expediently disposed in a circumferential annular groove that is preferably formed in the outer surface of an extension of the sleeve, with the ring being prevented from rotating, for example by means of a pin. The securing elements should be provided with corresponding notch-like grooves for receiving the ring.

The securing elements are suitably secured to the carrying disk via the force of a spring that acts upon the securing elements.

To secure the securing elements, a compression spring can be supported on those parts of the securing elements that face the carrying disk either directly or via an intermediate member. Where two securing elements are oppositely disposed in the sleeve, a further compression spring is expediently disposed between those parts of the securing elements that engage the carrying disk.

Pursuant to a modified embodiment of the present invention, however, the spring that acts upon the securing elements can be concentrically disposed in the sleeve and can be supported against the supporting elements via an intermediate member that is preferably adjustable.

In this connection, the intermediate member is suitably embodied as a pressing rod or working shaft that is shiftable in the sleeve, and upon which the spring acts via a plate or the like. In the vicinity of those parts of the securing elements that can pivot into the carrying disk, this intermediate member is provided with an adjustment member via which the securing elements can be pivoted outwardly and can be arrested in the securing position.

Guidance of the intermediate member can be effected by having this intermediate member displaceably held directly in a bore formed in a partition of the sleeve, and by having the intermediate member shiftably held in the end region of the sleeve, preferably via the adjustment member, which engages between the securing elements and/or in guide surfaces of the sleeve that are concentrically disposed and have the shape of portions of a circle.

It is also very advantageous to provide each of the outer surfaces of those parts of the securing elements that cooperate with the carrying disk with a thread that can be screwed either directly into the carrying disk or into a bushing that is disposed therein; in this way a positive and interlocking connection is provided between the handle and the carrying disk.

To adjust or shift the intermediate member, a grip can be provided that is shiftable to a limited extent on an extension of the sleeve. The grip is preferably provided with a knurling on its outer surface, and is provided with sealing means to prevent moisture from entering the sleeve. The grip is securely connected to the intermediate member via a pin or the like.

The adjustment member can be formed by a collar provided on the intermediate member, or by a tubular member that is provided on the intermediate member. The adjustment member is advantageously supported via curved surfaces that are provided on those longitudinal sides of those securing elements that face the adjustment member.

To return the securing elements, in one straightforward embodiment a pressure piece, for example in the form of a collar, can be disposed on the intermediate member. Counter to the force of the spring that is supported against the intermediate member or the securing elements, this pressure piece can be introduced between the free parts of the securing elements, which parts are preferably provided with curved surfaces.

Furthermore, for return of the securing elements, the inner sides of the free parts of the securing elements are also provided with curved surfaces between which the adjustment member can be introduced via the intermediate member.

Those curved surfaces of the securing elements that cooperate with the adjustment member and/or the pressure piece are expediently embodied as convexly curved circular portions that preferably extend over the entire, nearly equal angular ranges.

To prevent binding, those curved surfaces of the securing elements that cooperate with the adjustment member should be offset relative to the curved surfaces that cooperate with the pressure piece in such a way that a free path is provided during return of the securing elements.

In addition, respective linear guidances are suitably provided, ahead of the curved surfaces of the securing elements, which linear guidances extend parallel to the shifting direction of the adjustment member. The curved surfaces for guiding the adjustment member and/or the pressure piece have a concave cross-sectional shape, and are preferably circularly curved concentric to the central axis of the intermediate member.

However, those curved surfaces of the securing elements that cooperate with the adjustment member can also be embodied as concavely curved circular portions that in each case extend over nearly the same angular range. In this connection, contact or abutment surfaces that cooperate with the tubular member of the adjustment member can be provided on the securing elements between the curved surfaces thereof and/or in the end region of those parts that face the carrying disk. These abutment surfaces of the securing elements are planar or have a circular cross-sectional shape that is curved concentric to the central axis of the tubular member of the adjustment member. However, receiving grooves could also be formed in the tubular member for abutment against the securing elements.

For adjustment or alignment of the adjustment member and/or the pressure piece, the components that carry them are suitably shiftably interconnected via a thread.

In addition, the sleeve can be supported upon the stone body by a formed-on flange extension and an elastically deformable intermediate layer disposed thereon. Furthermore, in the region of the securing elements that engage the carrying disk, the sleeve should be provided with a guide piece that can be disposed in the opening or recess of the carrying disk.

With the curling stone of the present invention, it is possible to quickly detach the handle from the carrying disk without difficulty, and also to reestablish this connection just as easily, so that if necessary a carrying disk can easily be exchanged by the user of such a curling stone. This is realizable because if two or more securing elements are mounted on the handle in such a way that they are positively radially pivotably securable in a recess of the carrying disk, to couple the handle with the carrying disk it is merely necessary to insert the handle into the carrying disk after the adjustment member has been activated. The securing elements are secured with the carrying disk by the force of springs. If in addition a thread is provided on the securing elements, a rotation of only a few degrees results in a positive and interlocking connection that is also able to cope with very high stresses, especially if the securing elements that rest against the carrying disk can be arrested via the adjustment member. With the aid of the adjustment member or a pressure piece, the securing elements, possibly after loosening the screw connection, can be pivoted back into the sleeve by a slight turning back, and the handle, in this operating state of the securing elements, can without difficulty be withdrawn from or introduced into the stone body and the carrying disk.

The inventive proposed configuration thus permits a very simple manipulation during exchange of a carrying disk, so that the latter can be rapidly exchanged. Nevertheless, an extremely reliable connection results, especially if those curved surfaces of the securing elements that cooperate with the adjustment member are concavely curved. In addition, in order to be able to use variously embodied carrying disks, the securing elements can also be provided with varying threads, so that they can also be easily exchanged. With such a conversion or retrofitting, the utility and range of application are increased.

DESCRIPTION OF PREFERRED EMBODIMENTS

Figure 2:
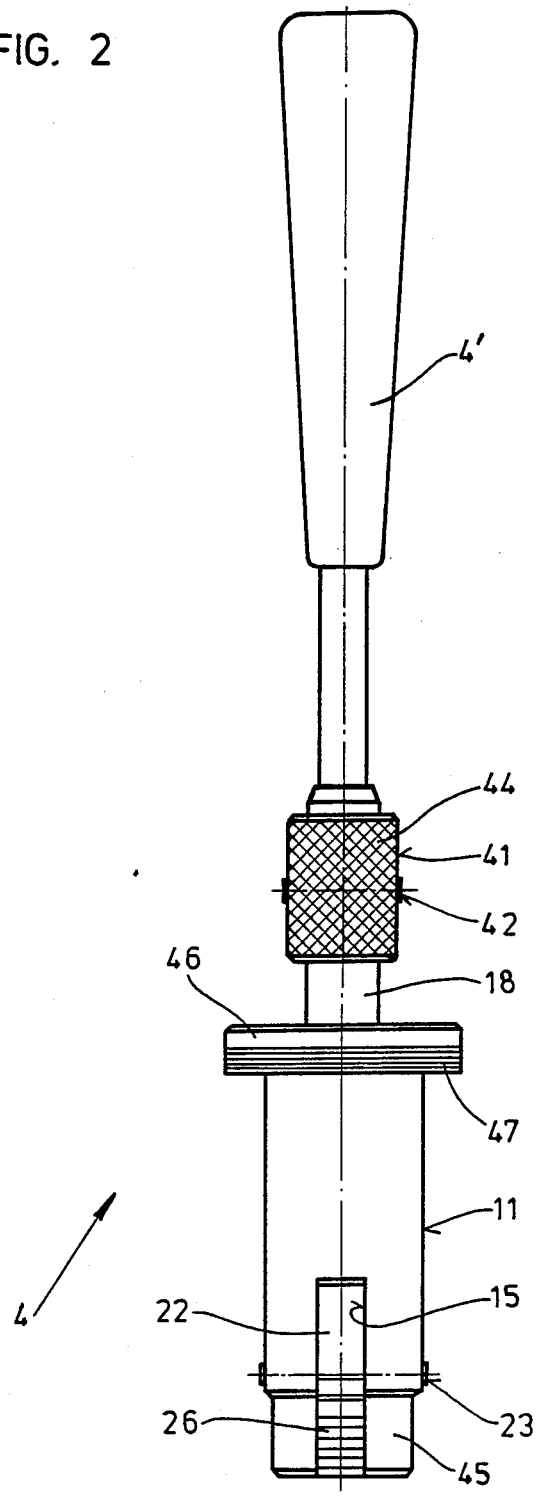
FIG. 2 is a side view of the handle portion of the curling stone of FIG. 1.
Figure 3:
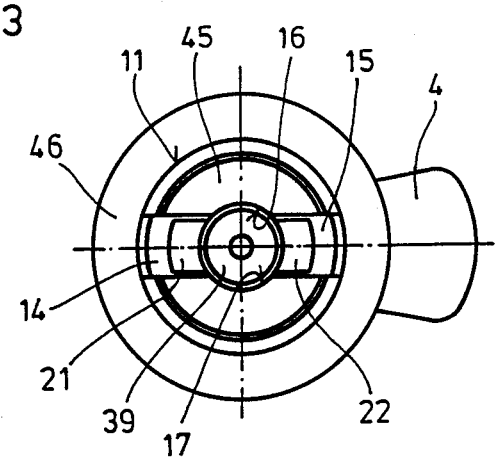
FIG. 3 is a bottom view of the curling stone of FIG. 1.

Referring now to the drawings in detail, the inventive curling stone illustrated in FIGS. 1 and 2 is designated by the reference numeral 1. This curling stone 1 for play on ice or asphalt comprises a stone body 2, a carrying plate or disk 3 that is interchangeably disposed in the stone body 2, and a handle 4 that extends through a bore 5 provided in the stone body 2 and is detachably connected to the carrying disk 3. The carrying disk 3 can be made of different materials in conformity with its application, and is provided with an inserted threaded sleeve or bushing 6 for receiving the handle 4.

The bottom end of the handle 4 is provided with a sleeve 11 that is secured to the handle via an extension 18 which on the one hand is screwed into a thread 19 of the sleeve 11, and on the other hand is screwed onto a thread 20 of a handle grip 4'. In addition, two oppositely disposed slot-like free spaces 14 and 15 are formed into the lower portion of the sleeve 11. To couple the sleeve 11 of the handle 4 with the bushing 6 of the carrying disk 3, securing elements 21 and 22 that are disposed on pivot pins 23 and that can be pivoted radially outwardly are held in the free spaces 14 and 15. It would, of course, also be possible to provide in the sleeve 11 three securing elements that are disposed at 120° relative to one another, or even four securing elements.

Figure 4:
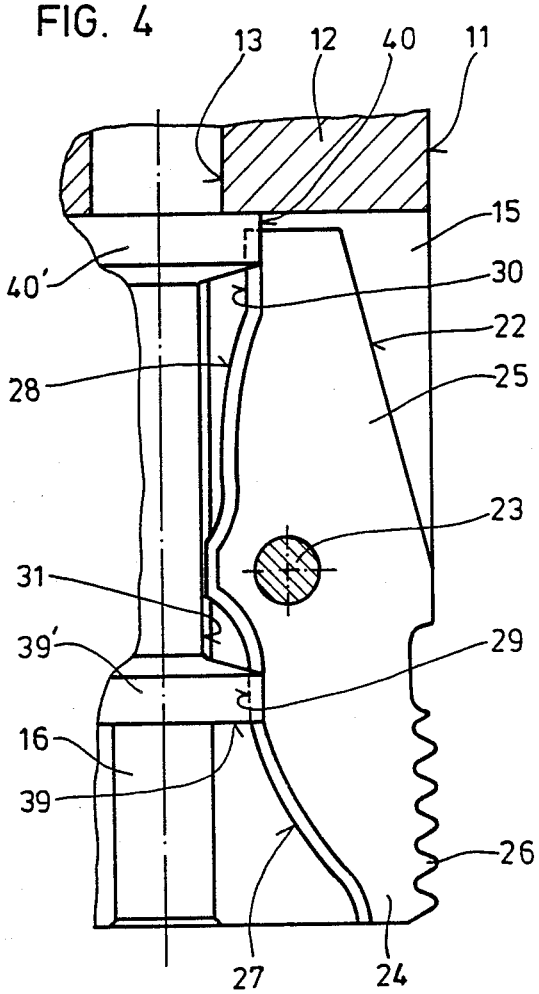
FIG. 4 is a fragmentary enlarged view illustrating the region of one securing element of the curling stone of FIG. 1.

The securing elements 21 and 22, embodied as a dual-armed lever, comprise the parts 24 and 25 (FIG. 4). The outer surface of each part 24 is provided with a thread 26 that can be screwed into the threaded sleeve 6. The inwardly directly surfaces of the parts 24 and 25, in contrast, are embodied as convexly curved surfaces 27 and 28 via which an adjustment member 39 and a pressure piece 40 cooperate. The adjustment member 39 is embodied as a collar 39' that is mounted on an intermediate member 31 against which a compression spring 34 is supported. The force of the compression spring 34 is thus transmitted to the securing elements 21 and 22.

The intermediate member 31 is formed by: a shaft 32, on which is disposed a plate 33 for supporting the compression spring 34; a threaded spacer rod 37, which is shiftably guided in a bore 13 that is formed in a partition 12 of the sleeve 11; and two shafts 36 and 38. The shaft 36 is connected to the shaft 32 via a thread 35 that is formed in the spacer rod 37; the shaft 38, in turn, is screwed into this thread 35. In addition, the pressure piece 40, in the form of a collar 40', is disposed on the shaft 38. The position of the adjustment member 39 and the pressure piece 40 relative to one another and in relation to the curved surfaces 27 and 28 of the securing elements 21 and 22 can thus be easily adjusted.

Via the force of the compression spring 34, the intermediate member 31 is pressed upwardly and is held in this position. As a result, the securing elements 21 and 22 are pivoted outwardly. The securing elements 21 and 22 are arrested in this position via the adjustment member 39, which is guided by circular surface sections 16 and 17 that are formed in the lower portion of the sleeve 11.

In order, after the handle 4 has been inserted through the bore 5 in the stone body 2, to be able to introduce the handle 4 into the threaded bushing 6 of the carrying disk 3 that is disposed in the stone body 2, the securing elements 21 and 22 have to be pivoted inwardly. For this purpose, the intermediate member 31 is pressed down against the force of the compression spring 34 with the aid of a grip 41, the outer surface of which is provided with a knurling 44. The grip 41 is fixedly connected to the intermediate member 31 via a pin 42. A slot 43 that receives the pin 42 is formed in the extension 18, so that the grip 41 and the intermediate member 31 can be pressed downwardly by a fixed adjustment path. In so doing, the securing elements 21 and 22 are pivoted inwardly by the pressure piece 40, which is also fixedly connected to the intermediate member 31.

As can be seen in FIG. 4, the curved surfaces 27 and 28, via which the adjustment member 39 and the pressure piece 40 cooperate, extend in the manner of circular arcs over nearly the same angular range. In this connection, the center point of the curved surface 27 is offset from the center point of the curved surface 28 in such a way that a free path is provided for the adjustment member 39 during a downward shifting movement, in this way, twisting motions are avoided. Furthermore, guide surfaces 29 and 30 that extend parallel to the axis of the intermediate member 31 are provided ahead of the curved surfaces 27 and 28 so that pivot movements of the securing elements 21 and 22 are not triggered immediately, and the securing elements are arrested in their position.

After the handle 4 has been introduced into the bore 5 of the stone body 2, by pressing down the grip 41 the sleeve 11, which is provided with a reduced-diameter guide piece 45, can be introduced into the threaded bushing 6 of the carrying disk 3. The sleeve 11 is supported upon the stone body 2 via a flange 46 and an elastic intermediate layer 47. If in this position the grip 41 is released, the securing elements 21 and 22, via the force of the compression spring 34, which force is transmitted to the securing elements via the adjustment member 39, are pivoted outwardly and their threads 26 mesh with the counterthread of the bushing 6. By subsequently rotating the handle 4 relative to the carrying disk 3 by a few degrees, a positive and interlocking connection can be established between the handle and the carrying disk since the securing elements 21 and 22 are arrested by the adjustment member 39 that is disposed between them. By pivoting the securing elements 21 and 22 inwardly with the aid of the pressure piece 40 by pressing down the intermediate piece 31, and if necessary by slightly turning back the handle 4, the positive connection is released. If the carrying disk 3 is sticking to the stone body 2, the carrying disk can be ejected from its seat with the aid of the handle 4.

Figure 5:
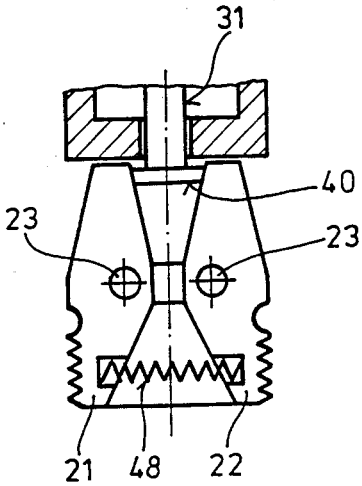
FIG. 5 is a fragmentary view showing a modified embodiment for the operation of the securing elements of the curling stone of FIG. 1.

As shown in FIG. 5, a compression spring 48 can be disposed between the securing elements 21 and 22, especially where the latter are arranged across from one another, in order to bring about outward pivoting movements of the securing elements. With the aid of the pressure piece 40 that is mounted on the intermediate member 31, with this embodiment also the securing elements 21 and 22 can be pivoted inwardly against the force of the spring 48 when the handle 4 is withdrawn and introduced into the carrying disk 3. It is to be understood that with this embodiment the threads on the securing elements 21 and 22 have to be appropriately configured.

Figure 6:
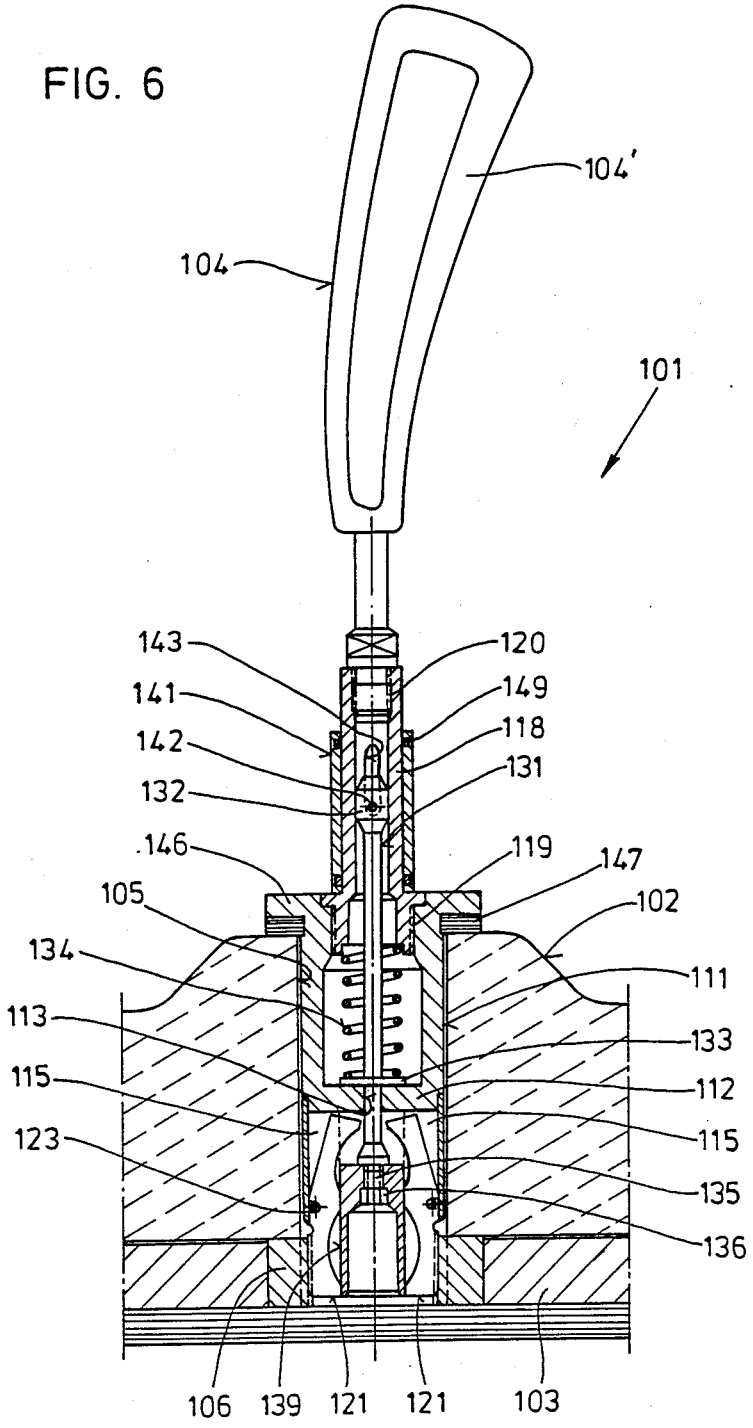
FIG. 6 is a partial axial cross-sectional view through a further exemplary embodiment of the inventive curling stone, which is provided with a removable handle.
Figure 7:
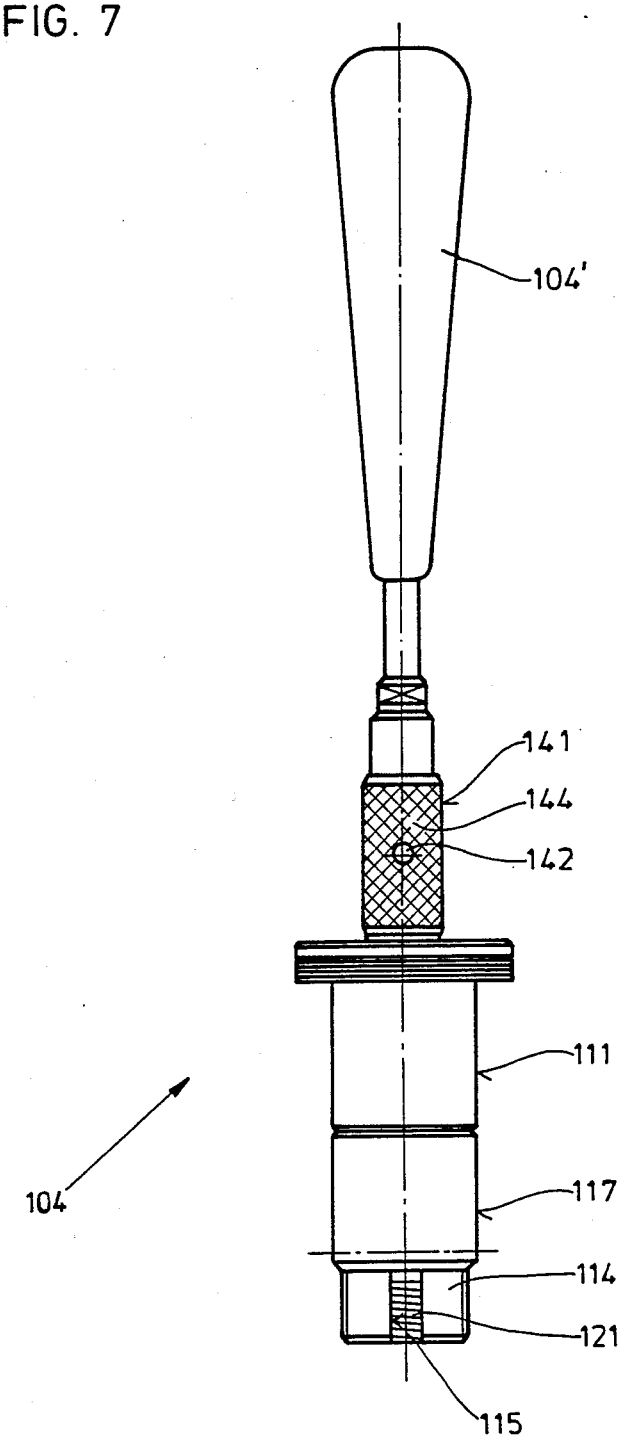
FIG. 7 is a side view showing the handle of the curling stone of FIG. 6.

The curling stone 101 illustrated in FIGS. 6 and 7 is embodied similarly to the curling stone of FIG. 1 and comprises a stone body 102, a carrying disk 103, and a handle 104 that again extends through a bore 105 formed in the stone body 102, with the handle 104 being secured in a threaded bushing 106.

In order to realize this securement, securing elements 121 are disposed in an extension 114 of a sleeve 111; these securing elements 121 are pivotably mounted in slots 115 that are formed in the extension 114 and are uniformly distributed about the periphery thereof. The securing elements 122 can be activated by an adjustment member 139. To pivotably mount these securing elements 121 of this embodiment, a holding ring 123 is provided, as can be seen in particular in FIGS. 8 and 9. The ring 123 is held in a circumferential groove 116 of the extension 114 and in notch-like grooves 122 formed in the securing elements 121. Via a pin 137 inserted in a bore 138 in the extension 114, the holding ring 123 is prevented from rotating; the holding ring 123 is additionally secured by a sleeve-like casing 117.

The adjustment member 139, which is embodied as a tubular member 140, is fixedly connected to an intermediate member 131 that is in the form of a working shaft 131'; the latter is shiftably guided in a bore 113 that is formed in a partition 112 of the sleeve 111. Via a pin 142 that is inserted into a greater-diameter portion 132, the shaft-like intermediate member 131 is secured to a grip 141 which, against the force of a compression spring 134 that acts upon a plate 133 formed on the intermediate member 131, is displaceable on an extension 118 that is screwed into the sleeve 111 via a thread 119. For this purpose, the extension 118, into the thread 120 of which the handle grip 104' of the curling stone 101 is screwed, is provided with a slot-like recess 143 in which the pin 142 is guided.

In the embodiment illustrated in FIGS. 6 and 7, the securing elements 121 are offset relative to one another by 120°. Curved surfaces 127 and 128, as concavely curved portions of a circle, are formed on the inner sides of the lower portions 124 and upper portions 125 of the securing elements 121. Provided between these curved surfaces 127 and 128, and on the bottom end of the parts 124, are abutment surfaces 129 and 130 that in cross section have a circularly curved shape and are concentric to the central axis of the tubular member 140.

If the grip 141, the outer surface of which is provided with a knurling 144, is pulled up against the force of the compression spring 134, the securing elements 121 are pivoted inwardly by the adjustment member 139, which in so doing acts upon the curved surfaces 128, and the connection with the carrying disk 103 is released. In the illustrated operating position, in contrast, the securing elements 121, which are provided with threads 126 on the outer side of the lower region, are pressed against the carrying disk 103 by the force of the compression spring 134 and are securely arrested in this position by the adjustment member 139, which is connected to the intermediate member 131 via a thread 135, since the securing elements 121 rest against the abutment surfaces 130. Thus even under great stresses a reliable securement of the handle 104 to the carrying disk 103 is assured. In addition, by rotating the handle 104 by a few degrees, the thread 106 of the securing elements 121 can mesh with the counterthread of the carrying disk 103. With the aid of a wrench opening 136, the adjustment member 139 can be securely fastened to the intermediate member 131.

Figure 10:
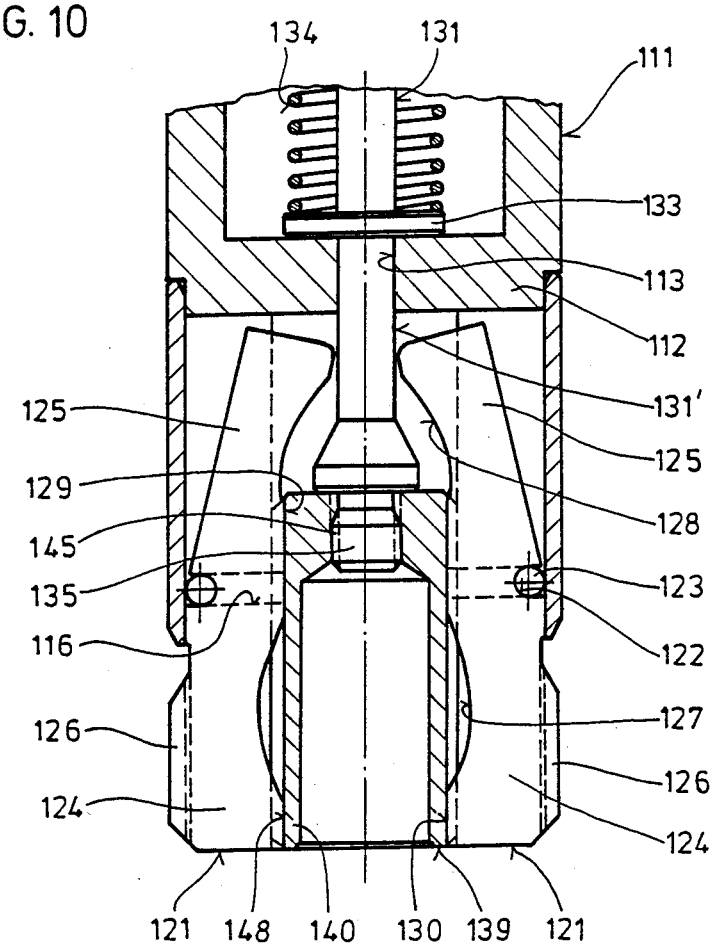
FIG. 10 is a fragmentary enlarged view illustrating a modified support for the securing elements of the curling stone of FIG. 6.
Figure 11:
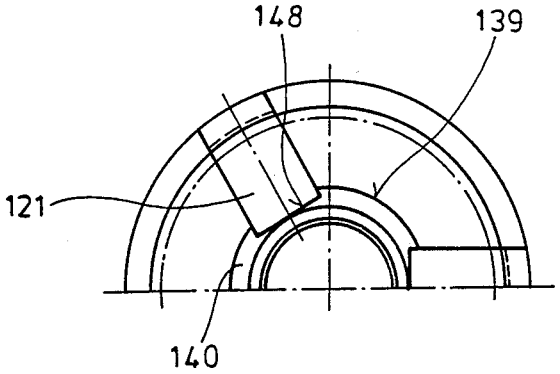
FIG. 11 is a plan view of the embodiment of FIG. 10.
Figure 12:
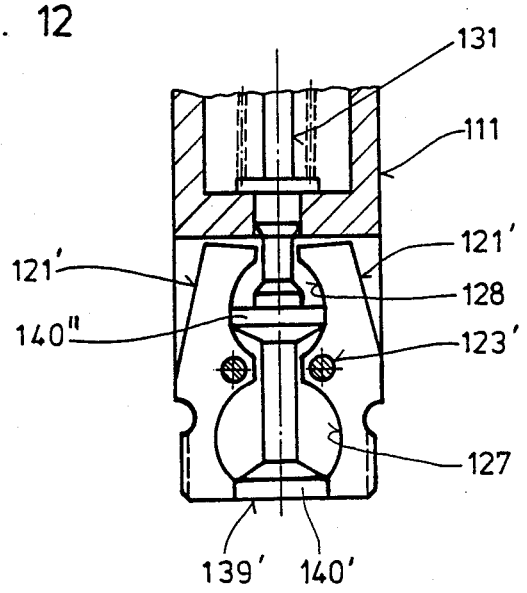
FIG. 12 is a view that illustrates a modified mounting for the securing elements of the curling stone of FIG. 6.

Alternatively, as shown in FIGS. 10 and 11, longitudinal grooves 148 can be formed in the tubular member 140 of the adjustment member 139. The securing elements 121, which are provided with planar abutment surfaces, engage in these longitudinal grooves 148. Since the securing elements 121 are held in the slots 115 and cannot rotate, when the threaded extension 135 of the intermediate member 131 is screwed into the inner thread 145 of the tubular member 140, the adjustment member 139 is also secured in the circumferential direction.

The sleeve 111 is supported upon the stone body 102 via a flange 146 and an elastic intermediate layer 147. Since seals 149 are disposed in the grip 141, moisture is prevented from reaching the interior of the handle 104.

Figure 13:
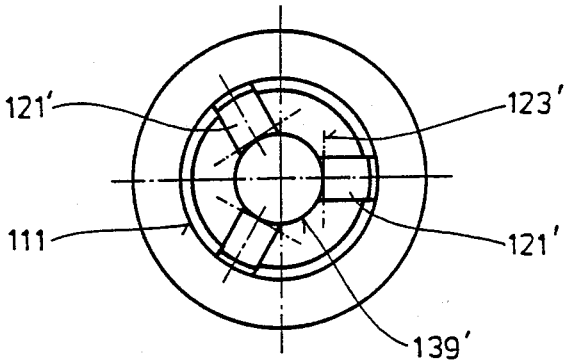
FIG. 13 is a plan view of the embodiment of FIG. 12.

In the modified embodiment illustrated in FIGS. 13 and 14, the securing elements 121' are pivotably mounted on pins 123', and the adjustment member 139' is provided with two collars 140' and 140'' that cooperate with the concavely curved guide surfaces 127 and 128 of the securing elements 121'. The latter are thus arrested by the collar 140' of the adjustment member 139' in the position where the handle is secured to the carrying disk.

The present invention is, of course, in no way restricted to the specific disclosure of the specification and drawings, but also encompasses any modifications within the scope of the appended claims.

What I claim is:

1. A curling stone for play on ice or asphalt, and including a handle that is interchangeably connected to a carrying disk that is inserted in a stone body, said curling stone further comprising:

at least two securing elements that are mounted on said handle to effect detachable connection of the latter to said carrying disk; said securing elements are positively radially pivotably mounted on said handle, with each of said securing elements having a portion that faces said carrying disk and can be secured to the latter in a recessed area thereof;

a sleeve that is secured to said handle and is provided with slot-like free spaces for accommodating said securing elements, each of which is in the form of a dual-armed lever that is pivotably mounted on said sleeve of said handle via pivot means that is held in said sleeve and is disposed at right angles to the longitudinal axis thereof, said pivot means being in the form of a ring; said sleeve including extension means in which are provided said slot-like free spaces and a circumferential groove for receiving portions of said ring; in which pin means are provided that extend into said ring to prevent the latter from turning; and in which said securing elements are provided with notch-like grooves for receiving other portions of said ring.

2. A curling stone according to claim 1, which includes a spring for acting upon said securing elements to secure the latter to said carrying disk.

3. A curling stone according to claim 2, which includes an intermediate member for supporting said spring directly or indirectly against that portion of each of said securing elements that faces said carrying disk.

4. A curling stone according to claim 1, in which said sleeve is provided with a flange on which is further provided an elastically deformable intermediate layer, via the two of which said sleeve is supported on said stone body.

5. A curling stone according to claim 1, in which said recessed area of said carrying disk includes a bushing with which said securing elements engage; and in which said sleeve, in the vicinity of the latter, is provided with guide means that can be introduced into said bushing.

6. A curling stone for play on ice or asphalt, and including a handle that is interchangeably connected to a carrying disk that is inserted in a stone body, said curling stone further comprising:

at least two securing elements that are mounted on said handle to effect detachable connection of the latter to said carrying disk; said securing elements are positively-radially pivotably mounted on said handle, with each of said securing elements having a portion that faces said carrying disk and can be secured to the latter in a recessed area thereof;

a sleeve that is secured to said handle and is provided with slot-like free spaces for accommodating said securing elements, each of which is in the form of a dual-armed lever that is pivotably mounted on said sleeve of said handle via pivot means that is held in said sleeve and is disposed at right angles to the longitudinal axis thereof;, a spring for acting upon said securing elements to secure the latter to said carrying disk;

an intermediate member for supporting said spring directly or indirectly against that portion of each of said securing elements that faces said carrying disk; and two securing elements disposed opposite one another in said slot-like free spaces of said sleeve; said spring being disposed between said securing elements and being supported in those portions thereof that can be secured in said carrying disk.

7. A curling stone according to claim 3, in which said spring that acts upon said securing elements is concentrically disposed in said sleeve and is supported against said securing elements via said intermediate member.

8. A curling stone according to claim 7, in which said intermediate member is embodied as a pressing rod or working shaft that is displaceably disposed in said sleeve and is provided with plate-like means upon which said spring acts; in the region of said portions of said securing elements that can be secured to said carrying disk by pivoting thereinto, said intermediate member is provided with an adjustment member for effecting pivoting-out of said securing elements, and arresting of the latter in a securing position thereof.

9. A curling stone according to claim 8, in which said sleeve, in the vicinity of said securing elements, is provided with a partition having a bore in which said intermediate member is displaceably held.

10. A curling stone according to claim 9, in which said adjustment member is guided between said securing elements and in turn guides said intermediate member.

11. A curling stone according to claim 8, in which said sleeve is provided with an extension upon which is disposed a grip that is displaceable to a limited extent, with said extension being fixedly connected to said intermediate member for effecting shifting of the latter.

12. A curling stone according to claim 8, in which said portions of said securing elements that can be secured to said carrying disk have longitudinal sides that face said adjustment member and on which are provided curved surfaces on which said adjustment member rests.

13. A curling stone according to claim 12, in which said adjustment member is formed by a collar on, or a tubular member secured to, said intermediate member.

14. A curling stone for play on ice or asphalt, and including a handle that is interchangeably connected to a carrying disk that is inserted in a stone body, said curling stone further comprising:

at least two securing elements that are mounted on said handle to effect detachable connection of the latter to said carrying disk; said securing elements are positively radially pivotably mounted on said handle, with each of said securing elements having a portion that faces said carrying disk and can be secured to the latter in a recessed area thereof;

a sleeve that is secured to said handle and is provided with slot-like free spaces for accommodating said securing elements, each of which is in the form of a dual-armed lever that is pivotably mounted on said sleeve of said handle via pivot means that is held in said sleeve and is disposed at right angles to the longitudinal axis thereof;, a spring for acting upon said securing elements to secure the latter to said carrying disk;

an intermediate member for supporting said spring directly or indirectly against that portion of each of said securing elements that faces said carrying disk, said spring that acts upon said securing elements being concentrically disposed in said sleeve and being supported against said securing elements via said intermediate member, said intermediate member being embodied as a pressing rod or working shaft that is displaceably disposed in said sleeve and is provided with plate-like means upon which said spring acts; in the region of said portions of said securing elements that can be secured to said carrying disk by pivoting thereinto, said intermediate member being provided with an adjustment member for effecting pivoting-out of said securing elements, and arresting of the latter in a securing position thereof; and each of said securing elements having a further portion remote from said carrying disk; and for retraction of said securing elements from said carrying disk, said intermediate member being provided with a pressure piece that can be introduced between said further portions of said securing elements against the force of said spring that acts on said intermediate member or said securing elements.

15. A curling stone according to claim 14, in which said further portions of said securing elements have inwardly directed curved surfaces, with the latter, as well as said curved surfaces of said portion of said securing elements that can be secured to said carrying disk, being convexly curved circular sections.

16. A curling stone according to claim 15, in which said curved surfaces that cooperate with said adjustment member are offset from said curved surfaces that cooperate with said pressure piece in such a way that during retraction of said securing elements, a free path exits.

17. A curling stone according to claim 16, in which adjacent said curved surfaces of both portions of said securing elements, respective linear guide surfaces are provided that extend parallel to the displacement direction of said adjustment member.

18. A curling stone according to claim 14, in which said further portions of said securing elements have inwardly directed curved surfaces, with said curved surfaces of both of said portions of said securing elements having a concave cross-sectional shape.

19. A curling stone according to claim 18, in which said curved surfaces of both of said portions of said securing elements are associated with said adjustment member, and are concavely curved circular sections that extend over nearly the same angular range.

20. A curling stone according to claim 19, in which abutment surfaces that cooperate with a tubular member of said adjustment member are provided in said securing elements between said curved surfaces of said portions thereof and/or on that part of said securing element portion for securement with said carrying disk remote from said other securing element portion.

21. A curling stone according to claim 20, in which said abutment surfaces of said securing elements have a planar cross-sectional shape, or a circularly curved cross-sectional shape that is concentric to the central axis of said tubular member of said adjustment member; and in which receiving grooves are provided in said tubular member to permit support of the latter on said securing elements.

22. A curling stone according to claim 14, in which said adjustment member and/or a pressure piece is threadedly connected to said intermediate member for proper alignment reasons.

23. A curling stone for play on ice or asphalt, and including a handle that is interchangeably connected to a carrying disk that is inserted in a stone body, said curling stone further comprising:

at least two securing elements that are mounted on said handle to effect detachable connection of the latter to said carrying disk; said securing elements are positively radially pivotably mounted on said handle, with each of said securing elements having a portion that faces said carrying disk and can be secured to the latter in a recessed area thereof;

a sleeve that is secured to said handle and is provided with slot-like free spaces for accommodating said securing elements, each of which is in the form of a dual-armed lever that is pivotably mounted on said sleeve of said handle via pivot means that is held in said sleeve and is disposed at right angles to the longitudinal axis thereof;, a spring for acting upon said securing elements to secure the latter to said carrying disk;

an intermediate member for supporting said spring directly or indirectly against that portion of each of said securing elements that faces said carrying disk, said spring that acts upon said securing elements being concentrically disposed in said sleeve and being supported against said securing elements via said intermediate member, said intermediate member being embodied as a pressing rod or working shaft that is displaceably disposed in said sleeve and is provided with plate-like means upon which said spring acts; in the region of said portions of said securing elements that can be secured to said carrying disk by pivoting thereinto, said intermediate member being provided with an adjustment member for effecting pivoting-out of said securing elements, and arresting of the latter in a securing position thereof; and each of said securing elements having a further portion remote from said carrying disk; and for retraction of said securing elements from said carrying disk, said securing elements having inwardly directed curved surfaces between which can be introduced said adjustment member via said intermediate member.

24. A curling stone for play on ice or asphalt, and including a handle that is interchangeably connected to a carrying disk that is inserted in a stone body, said curling stone further comprising:

at least two securing elements that are mounted on said handle to effect detachable connection of the latter to said carrying disk; said securing elements are positively radially pivotably mounted on said handle, with each of said securing elements having a portion that faces said carrying disk and can be secured to the latter in a recessed area thereof;

a sleeve that is secured to said handle and is provided with slot-like free spaces for accommodating said securing elements, each of which is in the form of a dual-armed lever that is pivotably mounted on said sleeve of said handle via pivot means that is held in said sleeve and is disposed at right angles to the longitudinal axis thereof; and those portions of said securing elements that face said carrying disk for cooperation, via securement, therewith, being provided with thread means for direct engagement with said carrying disk via said recessed area thereof.

* * * * *